United States Patent [19]

Punako et al.

[11] Patent Number: 4,611,873

[45] Date of Patent: Sep. 16, 1986

[54] INSERT ASSEMBLY FOR A CONNECTOR

[75] Inventors: Stephen Punako, Bainbridge; David O. Gallusser, Oneonta, both of N.Y.

[73] Assignee: Allied Corporation, Morris Township, Morris County, N.J.

[21] Appl. No.: 571,300

[22] Filed: Jan. 16, 1984

[51] Int. Cl.[4] ..... H01R 4/00

[52] U.S. Cl. ..... 339/94 M; 339/218 M; 339/143 R; 339/177 R

[58] Field of Search ..... 339/177 R, 177 E, 94 R, 339/94 M, 143, 218 R, 218 M, 14 R, 14 P

[56] References Cited

U.S. PATENT DOCUMENTS

| | | | |
|---|---|---|---|
| 3,292,131 | 12/1966 | Porch | 339/218 M |
| 3,539,973 | 11/1970 | Antes et al. | 339/143 R |
| 3,718,887 | 2/1973 | Solomon et al. | 339/218 M |
| 3,920,304 | 11/1975 | Bromberg | 339/94 |
| 3,961,294 | 9/1976 | Hollyday | 333/79 |
| 3,978,377 | 8/1976 | Constantine | 339/218 M |
| 4,020,430 | 4/1977 | Vander Heyden | 333/79 |
| 4,029,386 | 6/1977 | Krantz et al. | 339/143 R |
| 4,079,343 | 3/1978 | Nijman | 333/79 |
| 4,126,370 | 11/1978 | Nijman | 339/143 R |
| 4,187,481 | 2/1980 | Boutros | 333/182 |
| 4,195,272 | 3/1980 | Boutros | 333/182 |
| 4,222,626 | 9/1980 | Hollyday et al. | 339/147 R |
| 4,264,116 | 4/1981 | Gliha, Jr. | 339/89 M |
| 4,276,523 | 6/1981 | Boutros et al. | 339/143 R |
| 4,296,390 | 10/1981 | Vanderheyden et al. | 333/182 |
| 4,349,241 | 9/1982 | Juris et al. | 339/143 R |
| 4,362,350 | 12/1982 | von Harz | 339/143 R |
| 4,406,506 | 9/1983 | Baldwin | 339/143 R |

*Primary Examiner*—Gil Weidenfeld
*Assistant Examiner*—David L. Pirlot
*Attorney, Agent, or Firm*—Anibal Jose Cortina

[57] ABSTRACT

This invention relates to a connector assembly and more particularly to an insert assembly (20) that enables more than one coaxial contact (40) to be mounted within and grounded to a connector housing (10). The insert assembly is characterized by a planar metal member (21) and a planar plastic member (24) molded to the planar metal member (21). Both planar members (21, 24) having a plurality of axially extending and axially aligned bores (27) containing means (31, 41, 28) for retaining respective coaxial terminals (40) in each of the bores (27). The insert assembly (20) is mounted in the connector housing (10) so that the planar metal member (21) is an electrical contact with the housing (10). The invention provides a connector for releasably retaining a plurality of coaxially cable terminates (40) without the need to handwire together their metal sheaths (81).

14 Claims, 5 Drawing Figures

INSERT ASSEMBLY FOR A CONNECTOR

This invention relates to connectors of the type having terminals mounted therein and more specifically to an insert for retaining two or more coaxial terminals and grounding out unwanted electrical signals between terminals.

An electrical connector assembly is used to connect together the terminals at the ends of two or more wires. The connector assembly generally includes two housings that are coupled together by a coupling ring rotatably mounted on one of the housings. Each of the housings has an insert comprised of a dielectric material for retaining and electrically isolating the terminals at the ends of the wires or cables.

In applications using coaxial cables and contacts, connector assemblies connect together only two coaxial cables. To ground out unwanted electrical signals the outer electrically conducting braided metal sheath of the cable is connected to the connector housing. In instances where more than one pair of coaxial cables and terminals are involved, it is necessary to wire together the outer metal sheaths of all the cables to ground out unwanted signals. This is most difficult and time consuming and, if not properly accomplished, does not electrically connect together the cable sheaths and connector housings, resulting in unwanted electrical signals affecting the electrical conductors within the coaxial cables.

DISCLOSURE OF THE INVENTION

The invention is an insert assembly for a connector that enables more than one coaxial contact to be mounted within and grounded to the connector housing. The insert assembly is characterized by a planar metal member and a planar plastic member molded to the planar metal member. Both planar members having a plurality of axially extending and axially aligned bores containing means for retaining respective coaxial terminals in each of the bores. The insert assembly is mounted in the connector housing so that the planar metal member is in electrical contact with the housing.

One advantage of the invention is that it provides a connector assembly that retains a plurality of coaxial cable terminals and electrically connects together the outer metal sheaths of each of the cables to the connector housing.

Another advantage of the invention is that it provides a housing for releasably retaining a plurality of coaxial cable terminations.

Another advantage of the invention is that it eliminates the need to hand wire together the metal sheaths of a plurality of coaxial cables transmitting signals.

Another advantage of the invention is that it provides a simple apparatus for connecting together a plurality of coaxial cables.

DETAILED DESCRIPTION OF THE INVENTION

Figure 1:
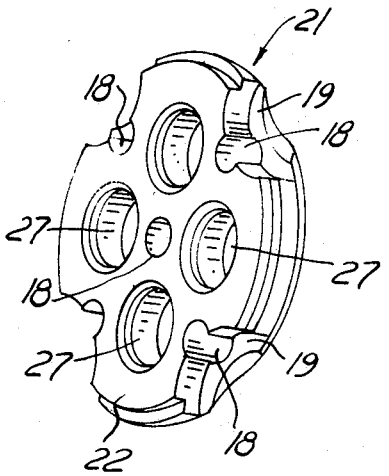
FIG. 1 is a perspective view of the planar metal member portion of the insert assembly.

Referring now to the drawings, FIG. 1 illustrates a perspective view of the planar metal member 21 which is preferably comprised of copper. The planar metal member 21 includes a front face 22 and a plurality of axially extending bores 27 each adapted to receive and retain a coaxial terminal (not shown). Voids 18 and shoulders 19 in the member 21 are adapted to receive a portion of a plastic molding compound to assist in the securing of a molded plastic member to the metal planar member 10.

Figure 2:
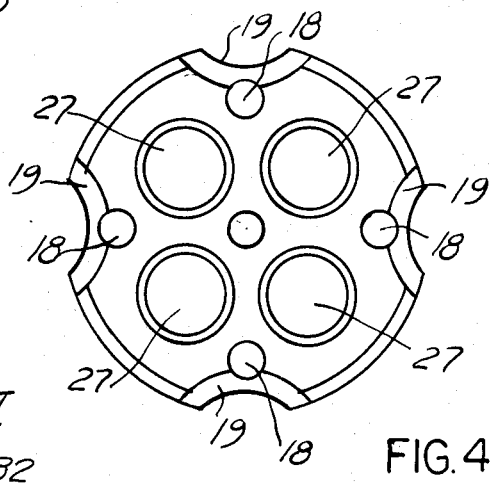
FIG. 2 is a front view of the planar metal member.

FIG. 2 is a front view of the metal planar member 21 shown in FIG. 1.

Figure 3:
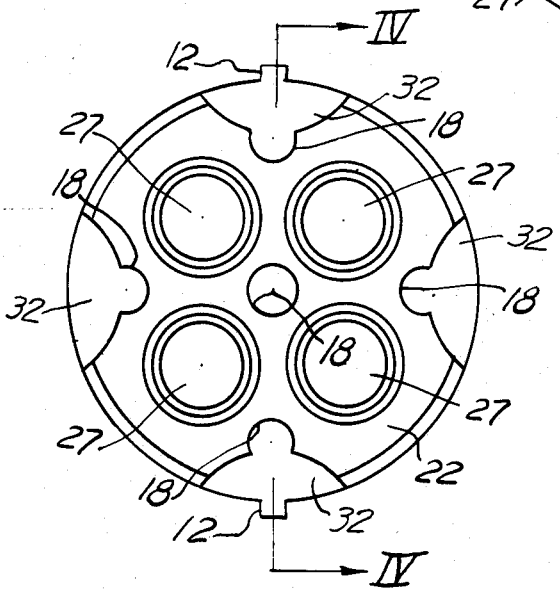
FIG. 3 is a front view of the planar plastic member molded to the planar metal member.

FIG. 3 illustrates a front view of the planar metal member 21 having bonded to its rear face a planar plastic member. Portions 32 of the planar plastic member extend into the voids 18 and cover the shoulders (19, FIGS. 1, 2) to improve the mechanical connection of the plastic member bonded to the metal member 21. Axial shoulders 12 mate with an axial groove (13, FIG. 5) to locate and guide the completed insert assembly into a connector housing.

Figure 4:
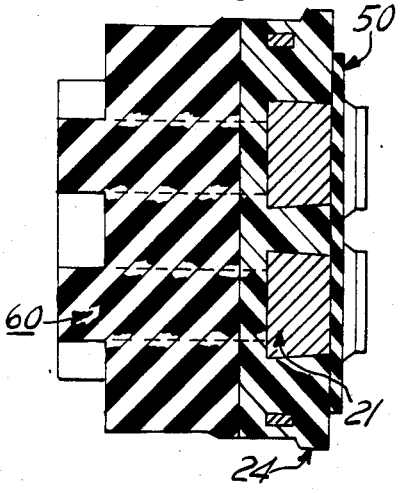
FIG. 4 is a cutaway view taken along lines IV—IV of FIG. 3.

FIG. 4 is a side view of the integral metal and plastic members 21, 24 taken along lines IV—IV of FIG. 3 and additional elements of the insert assembly 20 which now comprises: a planar metal member 21; a planar plastic member 24, molded to the rear face 23 of the metal member 21; a first planar rubber sealing member 50 bonded to the front face 22 of the planar metal member 21; and a second planar rubber sealing member 60 bonded to the rear face 25 of said planar plastic member 24. It is the function of the first planar rubber sealing member 50 to provide an interfacial seal when its forward face is pressed against the forward face of a substantially identical insert assembly of another connector assembly. The rubber sealing member 60 has a plurality of axial bores 61 in pressure tight relationship with the coaxial terminal (40, FIG. 5) to provide a moisture seal.

Figure 5:
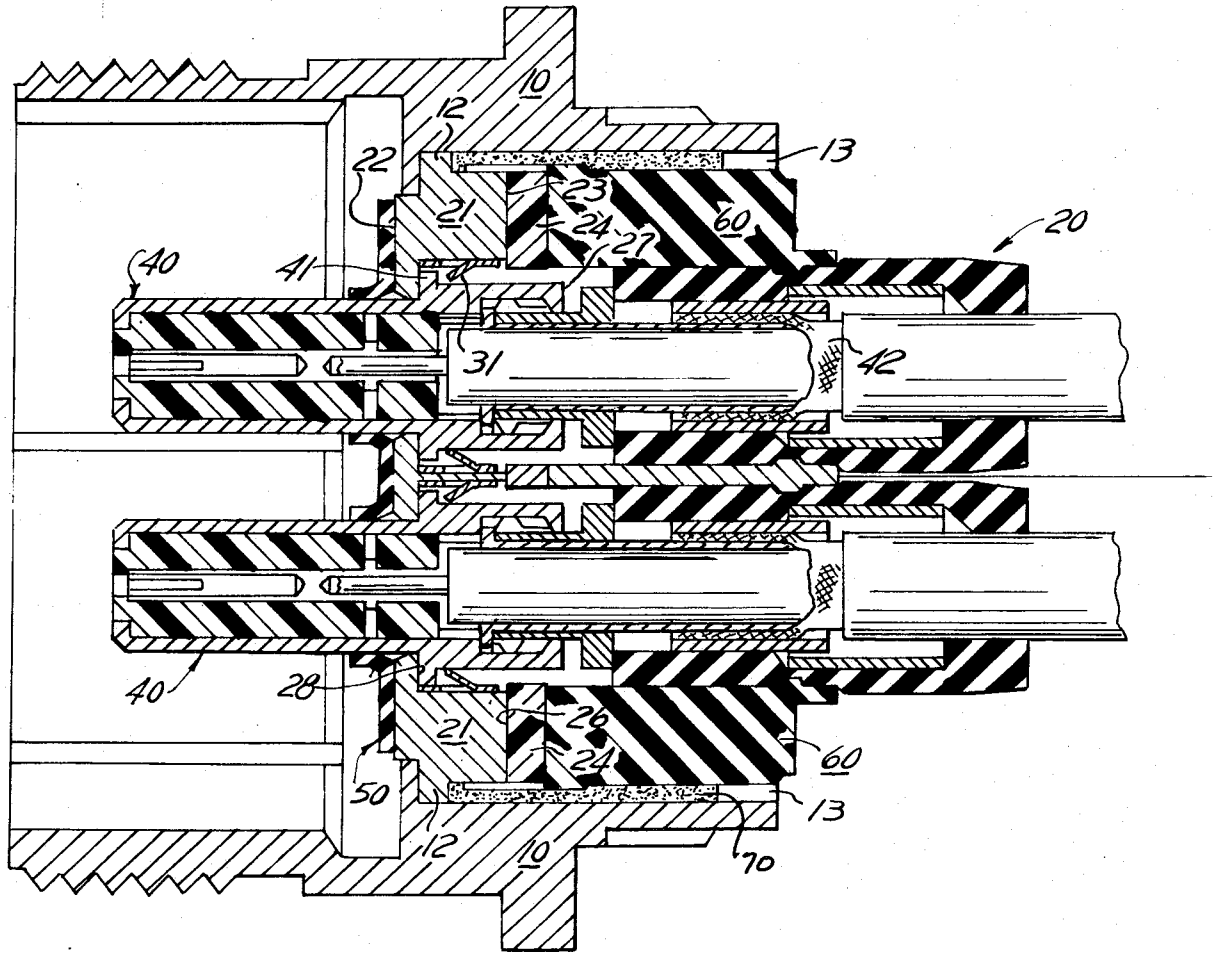
FIG. 5 is a cross sectional view of a connector assembly showing incorporating the principle of this invention.

FIG. 5 is a cross sectional diagrammatic view of a connector assembly incorporating the principles of this invention.

This figure illustrates the insert assembly 20 mounted within the connector housing 10. The insert assembly 20 includes a planar metal member 21 having a front face 22 and a rear face 23, with the metal member 21 in electrical contact with said housing 10. A plastic planar member 24 having a rear face 25 and a front face 26 is molded to the rear face 23 of the metal member 21. The plastic and metal members 21, 24 each have a plurality of axially extending and axially aligned bores 27. Located in each of the bores 27 are contact retention sleeves having a plurality of inwardly extending and radially deflectable spring fingers 31. The spring fingers 31 and the shoulder 28 in the planar metal member 21 captivate the enlarged portion 41 of the coax terminal 40 to releasably retain the terminal 40 in the bore 27 of the insert assembly 20.

To locate the insert assembly 20 in a predetermined position relative to the tubular housing 10 there is an axial groove 13 in the housing and an axial shoulder 12 on the insert assembly 20. The shoulder 12 is received by the groove 13 to orient the axial bores 27 in the insert assembly 20 in a predetermined position in the tubular housing 10. A silicone adhesive 70 is used to mount the insert assembly in the connector housing. The coaxial cables 80 have their braided metal outer sheath 81 electrically connected to the terminal 40 by sleeve 42.

The method of making the insert assembly 20 for insertion into a tubular connector housing 10 may be accomplished by first placing the planar metal member 24 shown in FIGS. 1 and 2 into a mold and then molding to the rear face 23 of the planar metal member 21 a planar plastic member 24 to obtain an integral one piece planar insert assembly 20 having a plurality of axial bores 27 therethrough. Rubber sealing members 50 and 60 may then be bonded to the front face 22 of said metal member 21 and to the rear face 25 of said plastic member 24. The resultant insert assembly 20 is then mounted within the connector tubular metal housing 10 with a portion of the planar metal member 24 in electrical contact with the tubular metal housing 10. Mounting may be accomplished by a silicone adhesive 70 applied to the area between the housing 10 and insert assembly.

Having described the invention, what is claimed is:

1. In combination with a connector of the type having a tubular metal housing, an insert assembly and means for mounting said insert assembly within said tubular housing, the improvement wherein the insert assembly comprises:

a planar metal member having a front face and a rear face, said metal member in electrical contact with said housing, having a plurality of axially extending bores, and having void means extending substantially parallel to the central axis of said planar metal member for receiving portions of a planar plastic member;

a planar plastic member having a rear face and a front face molded to the rear face of the metal member and having portions extending from said front face and into said void means thereby enhancing mechanical connection of the planar plastic member to the planar metal member, said plastic member having a plurality of axially extending and axially aligned bores coextensive respectively with said bores of said planar metal member for receiving a respective insertable terminal within, which extends from each of said coextensive planar metal member bores and said planar plastic member bores, in a manner such that each terminal is electrically connected to said tubular metal housing through said planar metal member; and means for retaining a respective terminal in each of the bores in said planar members so that each terminal is in electrical contact with said metal planar member.

2. The connector as described in claim 1 including:

at least one axially extending void in said planar metal member having therein an axially extending portion of said planar plastic member.

3. The connector as described in claim 1 further comprising a plurality of insertable terminals respectively received and releasably retained in each of said bores in said planar members, and each of said terminals being connected to a coaxial cable in a manner such that the metal outer sheath of each coaxial cable is electrically connected to the respective terminal for grounding out unwanted electrical signals to the connector housing.

4. The connector as described in claim 1 wherein said insert assembly further comprises:

a first planar rubber sealing member having a plurality of axial bores axially aligned with the bores in the metal and plastic planar members, said first rubber sealing member bonded to the front face of the planar metal member; and a second planar rubber sealing member having a plurality of axial bores therein axially aligned with the axial bores in the other planar members, said second planar sealing member bonded to the rear face of said planar plastic member.

5. The connector as described in claim 4 including:

at least one axially extending void in said planar metal member having therein an axially extending portion of said planar plastic member.

6. The connector as described in claim 4 further comprising a plurality of insertable terminals respectively received and releasably retained in each of said bores in said planar members, and each of said terminals being connected to a coaxial cable in a manner such that the metal outer sheath of each coaxial cable is electrically connected to the respective terminal for grounding out unwanted electrical signals to the connector housing.

7. The connector as described in claim 1 including an axial groove and an axial shoulder, said groove in one of said insert assembly and said housing, said shoulder on the other of said insert assembly and said housing, said shoulder received by said groove to orient the axial bores in said insert assembly in a predetermined position relative to said tubular housing.

8. The connector as described in claim 7 including:

at least one axially extending void in said planar metal member having therein an axially extending portion of said planar plastic member.

9. The connector as described in claim 4 including an axial groove and an axial shoulder, said groove in one of said insert assembly and said housing, said shoulder on the other of said insert assembly and said housing, said shoulder received by said groove to orient the axial bores in said insert assembly in a predetermined position relative to said tubular housing.

10. The connector as described in claim 9 including:

at least one axially extending void in said planar metal member having therein an axially extending portion of said planar plastic member.

11. In combination with a connector of the type having a tubular metal housing, an insert assembly and means for mounting said insert assembly within said tubular housing, the improvement wherein the insert assembly comprises:

a planar metal member having a front face and a rear face, said metal member in electrical contact with said housing, having a plurality of axially extending bores, and having void means extending substantially parallel to the central axis of said planar metal member for receiving portions of a planar plastic member;

a planar plastic member having a rear face and a front face and molded to the rear face of the metal member and having portions extending from said front face and into said void means thereby enhancing mechanical connection of the plastic member to the metal member, said plastic member having a plurality of axially extending and axially aligned bores coextensive respectively with said bores of said planar metal member for receiving a respective insertable terminal within, which extends from each of said coextensive planar member bores and said planar plastic member bores, in a manner such that each terminal is electrically connected to said tubular metal housing through said planar metal member;

first planar rubber sealing member bonded to the front face of said planar metal member for providing an interfacial seal when the forward face is pressed against the forward face of a substantially identical insert assembly of another connector assembly;

second planar rubber sealing member bonded to the rear face of said planar plastic member, said second planar rubber sealing member having a plurality of axial bores configured in a manner such that a pressure tight relationship is established with terminals received therein for providing a moisture seal; and means for retaining a respective terminal in each of the bores in said planar members so that each terminal is in electrical contact with said metal planar member.

12. The connector as described in claim 13 including an axial groove and an axial shoulder, said groove in one of said insert assembly and said housing, said shoulder on the other of said insert assembly and said housing, said shoulder received by said groove to orient the axial bores in said insert assembly in a predetermined position relative to said tubular housing.

13. The connector as described in claim 11 wherein said void means comprises at least one axially extending void having received therein an axially extending portion of said planar plastic member.

14. The connector as described in claim 11 further comprising a plurality of insertable terminals respectively received and releasably retained in each of said bores in said planar members, and each of said terminals being connected to a coaxial cable in a manner such that the metal outer sheath of each coaxial cable is electrically connected to the respective terminal for grounding out unwanted electrical signals to the connector housing.

* * * * *